United States Patent [19]

Boberg et al.

[11] 4,213,885

[45] Jul. 22, 1980

[54] BONDING AGENT FOR SHEET-FORMED FIBRE PRODUCTS

[75] Inventors: Anders Boberg; Bernt Larsson; Folke Lundh, all of Karlskoga, Sweden

[73] Assignee: Aktiebolaget Bofors, Bofors, Sweden

[21] Appl. No.: 916,177

[22] Filed: Jun. 16, 1978

[30] Foreign Application Priority Data

Jun. 23, 1977 [SE] Sweden ..... 7707295

[51] Int. Cl.[2] ..... C08L 33/14

[52] U.S. Cl. ..... 260/29.6 TA; 260/29.4 UA; 260/29.6 H; 260/29.6 HN

[58] Field of Search ..... 260/29.4 UA, 29.6 H, 260/29.5 HN, 29.6 TA

[56] References Cited

U.S. PATENT DOCUMENTS

| | | | |
|---|---|---|---|
| 2,923,653 | 2/1960 | Matlin | 260/29.6 H |
| 2,959,497 | 11/1960 | Williams | 260/29.6 TA |
| 3,231,533 | 1/1966 | Garrett | 260/29.6 TA |
| 3,806,484 | 4/1974 | Dargan | 260/29.6 TA |
| 3,853,803 | 12/1974 | Anderson | 260/29.6 TA |
| 4,076,677 | 2/1978 | Sekmakas | 260/29.6 TA |
| 4,077,932 | 3/1978 | Columbus | 260/29.6 H |

*Primary Examiner*—Paul R. Michl

*Attorney, Agent, or Firm*—Pollock, Vande Sande & Priddy

[57] ABSTRACT

Composition and sheet-formed fibre products from fibrous material and bonding agent containing certain emulsion polymerized polymers of hydrophobic monomer being styrene, or 2-ethylhexyl acrylate or butyl acrylate or mixtures; hydrophilic monomer being acrylamide, or methacrylamide or acrylonitrile, or 2-hydroxyethyl methacrylate, or vinylpyrrolidone or mixtures, and a cation-active charged monomer.

13 Claims, No Drawings

BONDING AGENT FOR SHEET-FORMED FIBRE PRODUCTS

The present invention relates to an additive and bonding agent for fibre products produced through dewatering and drying of fibre pulp suspended in water.

The bonding agent according to the invention consists of a thermoplastic polymer product which is produced through emulsion polymerization of monomers of certain types which are specified in the following. With the method in question of producing the polymer, this is obtained in the form of a particle dispersion consisting of fine particles dispersed in water, with a mean diameter of 0.05–0.3 μm. This particle dispersion in itself is entirely ready to be mixed into the fibre material suspended in water, or the stock.

By utilizing carefully selected monomer combinations and emulsifier systems for the production of the polymer in question, it has been possible to give the individual polymer particles a cation-active nature, at least in environments of which the pH is below 7, i.e. within the pH interval prevailing in conventional pasteboard and paper manufacture.

As the fibre material, cellulose and synthetic fibres, which can come into question in this connection is more or less anion-active in the water suspension, no addition of alum or other retention agents is required in order to precipitate the polymers on the fibres. The affinity thereby achieved between the polymer particles and the fibres is usually so high that the pulp will withstand a beating without the polymer particles being desorbed.

The function of the polymer as a thermoplastic and as a bonding agent makes it possible to produce fibre products which are plastic at temperatures exceeding the softening point of the polymers. At temperatures below this softening point, the polymer becomes hard, and then gives hard and stiff products, with good dimensional stability.

In the finished fibre product, in addition to the above-mentioned functions, the polymer functions as a hydrophobing agent (neutral glue) and thereby gives the fibre product extremely low hygroscopicity.

A polymer additive in accordance with the present invention also gives the finished fibre product substantially improved wet and dry strength, and therewith, a general increase in strength, e.g. in the form of increased Z-strength and an equalizing between the differences in strength along and across, respectively, the fibre direction of the finished product. The polymer additive according to the invention also gives the finished product substantially improved wear resistance.

The addition of an appropriate quantity of the bonding agent according to the invention to cellulose fibre stock moreover makes it possible to mix into same large quantities of materials which themselves are not capable of developing coherent bonds with the cellulose fibres, without the product produced by dewatering and drying of the stock thereby obtaining unsatisfactory tensile and/or tearing strength. This, for instance, makes it possible to mix in large quantities of mineral fibres, chalk and/or leather or rubber waste into cellulose pulp. It is thereby possible to produce e.g. cheap leather-like products of leather waste, and cheap lining pasteboard from rubber waste.

We have also been able to establish that the bonding agent according to the invention functions as a retention agent for colloidal filling and for the fine fractions of cellulose fibres. The function of the bonding agent as a retention agent can be further amplified if this is combined with a highmolecular polyethylene oxide.

In its most general form, the bonding agent according to the invention consists of a thermoplastic polymer product produced through emulsion polymerization of at least two different monomers. Of the two basic monomers which must absolutely be included, the first one, in the following designated A, must be a hydrophobic monomer or a mixture of hydrophobic monomers of the type styrene, 2-ethyl hexyl acrylate and/or butyl acrylate, while the other monomer which is absolutely necessary in this connection, in the following designated B, consists of a hydrophylic monomer, soluble in water, or a mixture of hydrophylic monomers of the type acrylamide, methacrylamide, acrylonitrile, 2-hydroxy ethyl methacrylate and/or vinyl pyrrolidone.

The content of the monomer A should be 95–65 percent by weight, and the content of the monomer B 3–30 percent by weight, all counted on the whole of the quantity of monomer comprised in the bonding agent.

As previously mentioned, one of the characteristic features of the bonding agent according to the invention is that the polymer particles are cation active at least in environments of which the pH is below 7.

The emulsion polymerization of the bonding agent should preferably be carried out according to a conventional preemulsifying technique, naturally in the presence of an emulsifying system adapted to the monomers used as the basic material, and in accordance with a known technique. As previously mentioned, the bonding agent is obtained in the form of polymer particles dispersed in water, with a particle size of 0.05–0.3 μm.

In addition to the monomers A and B, a cation-active charged monomer C can be included in the bonding agent, in a quantity corresponding to 0.5–5.0 percent by weight, counted on the whole of the quantity of monomer comprised in the bonding agent. The monomer C should then consist of a basic acrylic and/or methacrylic compound with the general formula

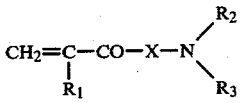

in which $R_1$=H or $CH_3$ $R_2$=$C_1$— to $C_4$—alkyl, —$CH_2$—OH or —$CH_2$—$CH_2$—OH $R_3$=-H or either of the alternatives according to $R_2$ while

X=—O—$CH_2$—$CH_2$—, —O—$CH_2$—$CH_2$—$CH_2$—,

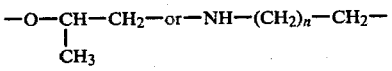

in which n=0 to 3

An example of such a monomer C as above is dimethyl amino ethyl methacrylate (DMAE-MA).

The emulsion polymerization of the monomers A and B and possibly also C should be carried out in the presence of a tenside adapted to this.

As the polymer particles after the addition to the fibre suspension are to have a cation-active character, it is advantageous to utilize a cation-active tenside at the polymerization.

The cation tensides which can be used for the production of dispersion according to the invention can be of the conventional type for emulsion polymerization, such as nitrogen bases, for instance $C_{12}$–$C_{14}$-fatty amino hydrochloride, coconut amino hydrochloride and cetyl trimethyl ammonium chloride or such as sulphonium salts, for instance dialkyl methyl sulphonium chloride and p-alkyl benzyl diethyl sulphonium chloride.

However, cation tensides which, in addition to a hydrophobic hydrocarbon part and a cation group, also contain stored up ethylene oxide units should preferably be used. For instance, according to the following general formula:

$$\begin{array}{c} (CH_2CH_2O)_n \\ R{-}N^+{-}CH_3 \\ (CH_2CH_2O)_m \end{array}$$

in which

R = a hydrocarbon radical with 8–20 carbon atoms and n and m = 5 – 30.

The desorption speed of this latter type of tenside from the surface of the polymer particles after the addition of the bonding agent to the fibre suspension is considerably more slow than that of conventional cation tensides, presumably owing to the attraction force between the poly/ethylene oxide chains and the hydrophylic monomers comprised in the polymer.

The bonding agent according to the invention should preferably be produced via so-called pre-emulsion technique. An emulsion of monomer in water is then added continuously to the reaction vessel in which water the major portion of the emulsifier and the growing polymer particles are present. In order to achieve an emulsion between monomer and water, it is appropriate to use 0.25–1.0 percent by weight counted on the quantity of monomer of a non-ionic emulsifier (tenside) for instance a nonyl phenol adduct with 20–30 ethylene oxide units stored.

The cation tenside to be comprised in a quantity preferably corresponding to 0.25–5.0 percent by weight can thus be complemented with 0.1–2.0 percent by weight non-ion tenside, all counted on the total quantity of monomers.

Appropriate initiators in connection with the present invention are those which do not introduce any anionic groups in the polymer, for instance hydrogen peroxide, azo-bis-isobutyl nitrile or organic peroxides, but also anionic initiators, such as potassium or ammonium persulphate can be used.

In addition to the monomers A, B and C, also a strongly basic monomer D with a $pk_b$ value $<5$ for instance a quarternary acrylate monomer such as Quolac Mer Q-5 ® from Unibasic Inc. can be comprised in the bonding agent. The monomer D should then comprise 0.2–2.0 percent by weight of the entire quantity of monomer comprised in the bonding agent.

Through the introduction of monomer D, the polymer particles will be cation charged also at pH values exceeding 7, even if there is no cation tenside included in the product.

According to a variant of the invention, the cation-active groups in the polymer are obtained by adding 1–40 percent by mol formaldehyde counted on the quantity of acrylic amide comprised in the bonding agent and also 1.5–60 percent by mol also counted on the acrylic amide of a secondary aliphatic amine, e.g. dimethyl amine, after the polymerization is over, after which the pH of the entire mixture is adjusted to a value of between 9 and 11, and cation-active groups, so-called Mannich basis are then formed in the polymer between its amide groups, the formaldehyde and the amine.

With this procedure, cation-active particles are thus obtained even in the absence of the cation-active components cation tenside and the monomers C and D, respectively. Another possible alternative is, starting with a monomer mixture containing 5–30 percent by weight acrylic amide, counted on the entire quantity of monomer and after the polymerization is over, to add 1–40 percent by mol formaldehyde, counted on the quantity of acrylic amide comprised in the bonding agent and in connection therewith to adjust the pH of the dispersion to a value of between 9 and 11, the formaldehyde then reacting with the amide groups in the polymer under the formation of n-methylol groups in same. The possibility hereby arises for the polymer to be bonded chemically to the fibre surface via the n-methylol group in the polymer and, for instance, hydroxyl groups on the fibre surface. Further, a cross-bonding of the bonding agent can take place between n-methylol groups and, for instance, hydroxyl groups, amide groups, or other n-methylol groups in the polymer.

According to a variant of the invention, this can also be produced with the aid of an anion-active tenside, such as lauric acid or stearic acid, an appropriate quantity of this tenside then being 0.25–4.0 percent by weight of the total quantity of monomer.

The polymer must then contain cation-active monomer of type C or, alternatively, be subjected to the previously mentioned Mannich reaction in order that the final product shall have the previously specified cation-active character in environments with pH $<7$.

The above-mentioned anion-active tenside can also be combined with 0.1–2.0 percent by weight counted on the total quantity of monomer of a non-ion tenside.

In addition to the previously mentioned monomers A, B, C and D, also a slightly acid monomer E can be comprised in the bonding agent, and as an example of the monomer E may be mentioned acrylic acid, methacrylic acid and itaconic acid.

The bonding agent according to the invention can thus contain e.g. 20–80 percent by weight styrene, 0–68 percent by weight 2-ethyl hexyl acrylate, 5–20 percent by weight acrylic amide and 1–4 percent by weight dimethyl amino ethyl methacrylate (counted on the entire quantity of monomer).

By varying the proportions of styrene/2-ethyl hexyl acrylate, the polymer can obtain different softening temperatures. This softening temperature is chosen in dependence on the requirements for the finished fibre product. If it is primarily to have dimensional stability, the softening temperature of the polymer should be above the normal temperature at which it is used. If the fibre product is primarily to be flexible, a considerably lower softening temperature for the polymer is required.

It is thus applicable, in general, for the particle-formed bonding agent according to the invention that after its addition to the fibre suspension, it is cation active. This cation activity originates from one or a plurality of the following sources 1. strongly basic groups in the polymer 2. slightly basic groups in the polymer, which are charged at the pH prevailing in the system fibre suspension+polymer dispersion
3. the cation tensides used for the production of the dispersion.

The anion-active groups possibly present from the anion-active monomers comprised in the anion-active tenside and/or in the polymer used at the production are considerably in the minority from the point of view of mols in relation to the total number of cation charges at the pH prevailing after the addition of the bonding agent to the fibre suspension. In the cases when the dispersion contains both strongly acid groups and slightly basic groups, the charge on the dispersion will switch from negative to positive at a certain pH, and therefore the pH at which it is used must be below this value.

Appropriate quantities of bonding agent to be added to the fibre suspension in question are 0.5–20 percent by weight of dry polymer, counted on the dry fibre.

As a retention-improving agent, also 0.001–0.1 percent by weight counted as dry polymer on dry fibre of a high-molecular polyethylene oxide dissolved in water can be added to the fibre suspension containing the bonding agent according to the invention. As an example may be mentioned Polyox® from Union Carbide.

The bonding agent according to the invention is moreover extremely stable against salting out. This is presumably due to the fact that the polymer particles consist of a necleus mainly containing hydrophobic monomer, surrounded by a water-swelled shell, mainly consisting of a hydrophylic monomer. This hydrophylic shell stabilizes the particles sterically. Further, it is assumed that the major portion of the cation-active groups of the polymer particles are embedded in water-swelled hydrophylic monomer, and that, consequently, a formation of salts between these groups and the anion-active disturbing substance in the fibre suspension cannot take place, for steric reasons. A prerequisite for precipitating particles is that there is a simultaneous coaction between several anion-active groups on a surface and several of the cation groups of the polymer particles. This condition is fulfilled just between the bonding agent and fibre surfaces such as cellulose fibre etc.

In the paper industry, aluminium sulphate (alum) is often used as a retention and/or gluing chemical. The capability of the bonding agent according to the invention of being stable against salting out involves that the alum can be mixed with the bonding agent in the proportion 5–50 percent by weight counted on the quantity of polymer, after which this mixture can be added to the fibre suspension in a common flow.

The following examples of embodiments are only intended to elucidate the invention, and are not to be regarded as any limitation of same. The invention has been defined in the accompanying claims.

PATENT EXAMPLES

Examples 1–8 show the production of different variants of the polymer dispersions according to the invention, while examples 9–17 show the function of the polymer in the fibre product.

EXAMPLE 1

48 g acrylamide was dissolved in 480 g distilled water. To this solution was added 278.4 g 2-ethyl hexyl acrylate (2-EHA), 144.0 g styrene, 9.6 g dimetyl amino ethyl methacrylate (DMAE-MA) and 5 g 24% water solution of non-ion tenside in a nonyl phenol adduct with 30 ethylene oxide units. This mixture was placed under stirring, whereby an emulsion was formed. To this emulsion was added 4 g 35% hydrogen peroxide and 3 g concentrated hydrochloric acid. The pre-emulsion thus obtained, kept under constant stirring, was charged at a uniform rate into a reactor during two hours. In this reactor there was an 85° solution of 640 g distilled water, 4.8 g cation tenside of the type quarternary ammonium compound (Berol 563 from Berol Kemi AB), 3 g concentrated hydrochloric acid, 4.5 g 0.5% iron ammonium sulphate and 0.3 g ascorbic acid. After 5 minutes of the dripping time, the polymerization started. When the dripping in had been completed, the polymer dispersion was kept at 90° for 2 hours, after which it was cooled and filtered. The cation-active low-viscosity polymer dispersion obtained had a dry content of 30%, a particle size of approx. 0.15 μm, and a softening temperature (TG) of the polymer of −10° C.

EXAMPLE 2

Using the same technique as in example 1, a dispersion with a dry content=25%, softening temperature=+45° C. and particle size 0.10 μm was prepared.

The pre-emulsion consisted of

| | | |
|---|---|---|
| acrylamide | 96 | g |
| distilled water | 795.9 | g |
| styrene | 254.4 | g |
| 2-EHA | 110.4 | g |
| DMAE-MA | 19.2 | g |
| non-ion tenside according to example 1, 24% solution | 5 | g |
| hydrogen oxide, 35% | 4 | g |
| concentrated hydrochloric acid | 7 | g |

The components charged into the reactor from the beginning were identical to those according to example 1.

EXAMPLE 3

Using the same technique as for example 1, a polymer dispersion with 40% dry content, softening temperature +43° and particle size 0.2 μm was prepared.

The pre-emulsion contained:

| | | |
|---|---|---|
| acrylamide | 24.0 | g |
| distilled water | 380 | g |
| styrene | 336 | g |
| 2-EHA | 115.2 | g |
| DMAE-MA | 4.8 | g |
| non-ion tenside according to example 1, 24% | 5.0 | g |
| hydrogen oxide, 35% | 4.0 | g |
| concentrated hydrochloric acid | 2.0 | g |

From the beginning. the flask contained:

| | | |
|---|---|---|
| distilled water | 350 | g |
| cation tenside according to example 1 | 14.4 | g |
| iron ammonium sulphate 0.5% | 4.5 | g |
| ascorbic acid | 0.3 | g |
| concentrated hydrochloric acid | 2.0 | g |

This example demonstrates how a dispersion is prepared anionic, but is cationic when used (example 9).

EXAMPLE 4

According to the pre-emulsion technique, a styrene-acrylate dispersion with a dry content=30%, particle size=0.10 μm and softening temperature for the polymer of +45° C. was prepared.

The pre-emulsion consisted of

| | | |
|---|---|---|
| distilled water | 260 | g |
| acrylamide | 27 | g |
| styrene | 148.5 | g |
| 2-EHA | 62.1 | g |
| DMAE-MA | 5.4 | g |
| lauric acid | 1.35 | g |
| NaOH 1% | 27 | g |
| ammonium persulphate | 0.5 | g |

This pre-emulsion was dripped down during 2 hours to the reactor, which was provided with a 75% liquid phase, consisting of

| | | |
|---|---|---|
| distilled water | 314 | g |
| trisodium phosphate | 1.40 | g |
| lauric acid | 1.35 | g |
| NaOH 1% | 27 | g |

After the dripping in of the pre-emulsion has been completed, the dispersion was kept at 85° C. for two hours, after which it was cooled and filtered.

EXAMPLE 5

A polymer dispersion was prepared via the pre-emulsion technique. On this dispersion, with dry content 30%, particle size 0.15 μm and softening temperature=0° C. the so-called Mannich reaction was carried out.

The pre-emulsion consisted of

| | | |
|---|---|---|
| distilled water | 260 | g |
| acrylamide | 27 | g |
| styrene | 99.9 | g |
| 2-EHA | 143.1 | g |
| non-ion tenside according to example 1, 24% | 2.25 | g |
| ammonium persulphate | 0.5 | g |

The liquid phase in the reactor consisted of

| | | |
|---|---|---|
| distilled water | 340 | g |
| trisodium phosphate | 1.40 | g |
| lauric acid | 1.35 | g |
| NaOH 1% | 27 | g |

The pre-emulsion was charged into the reactor continuously during two hours at 75°–80°, after which the dispersion was allowed to run at 80° for a further two hours. After cooling to 35°, 15.4 g 32% formalin and 30.0 g 40% dimethyl amine were added. After four hours' stirring at 35°–40°, the temperature was lowered to 25° and the product was filtered. Through the addition of the dispersion obtained, diluted with water to 5% dry content, to a 0.1 M formic acid solution in the proportion 300 ml 5% dispersion to 250 ml 0.1 M formic acid, it was established that the dispersion would withstand recharging from anion-active to cation-active without flocculating, and it was also established in a z-potentiometer that the dispersion was heavily cation active.

EXAMPLE 6

A dispersion was prepared according to example 5, but with the difference that 5.4 g DMAE-MA was included in the pre-emulsion and the styrene quantity was reduced to 94.5 g. After completed polymerization (two hours dripping down+a further two hours at 80°) the dispersion was cooled to 40°, after which 12.4 g 32% formalin was added and the pH was adjusted to 10 with 1% NaOH. After eight hours of stirring at 40°, the product was cooled and filtered. Through the addition of the dispersion diluted to 5% dry content to 0.1 M formic acid solution, it was established that the dispersion could be recharged without flocculating and that it was cation active at pH<7.

EXAMPLE 7

A styrene acrylate dispersion was made according to the same procedure as in example 1. A 35% dispersion with particle size=0.12 μm and softening temperature=+65° was obtained.

The pre-emulsion consisted of

| | | |
|---|---|---|
| distilled water | 376 | g |
| acrylamide | 38.4 | g |
| styrene | 360 | g |
| n-butyl acrylate | 72 | g |
| DMAE-MA | 4.8 | g |
| Quolac Mer Q5 80% | 6.0 | g |
| hydrogen peroxide 35% | 4.0 | g |
| non-ion tenside according to example 1 24% | 5.0 | g |

The liquid phase in the reactor was identical to the one according to example 1, apart from the fact that it contained 510 g distilled water instead of 640 g.

EXAMPLE 8

A styrene acrylate dispersion was prepared with particle size=0.2 μm, dry content=30% and softening temperature of the polymer=+36° C.

To a reactor containing

| | | |
|---|---|---|
| distilled water | 1500 | g |
| cation tenside according to example 1 | 4.8 | g |
| ascorbic acid | 0.3 | g |
| concentrated hydrochloric acid | 12 | ml |
| iron ammonium sulphate 0.5% | 4.5 | ml |

and heated to 85° was added continuously during two hours, from separate vessels (1) a monomer mixture consisting of

| | | |
|---|---|---|
| styrene | 278.4 | g |
| 2-EHA | 124.8 | g |
| DMAE-MA | 19.2 | g |
| 2-hydroxy ethyl methacrylate | 48.0 | g |
| acrylic acid | 9.6 | g |

(2) an initiator solution consisting of

| | | |
|---|---|---|
| hydrogen peroxide 35% | 4 | g |
| distilled water | 100 | g |

After the dripping in had been completed, the dispersion was allowed to run for a further two hours at 90°, after which it was cooled and filtered.

EXAMPLE 9

With a dispersion prepared according to example 4, it is illustrated how polymer dispersions according to the invention function as hydrophobing agents, i.e. substances which reduce the water absorption capability in fibre products.

To a 2% suspension of recycled fibres (daily newspapers) in water, a dispersion corresponding to 0.5% polymer on the weight of the fibres was added, and thereafter the pH of the stock was adjusted to pH=4.5 with aluminium sulphate. When the polymer after approx. 5 minutes had been completely absorbed on the fibres, the pulp was dewatered in a laboratory sheet former. After pressing and drying in a heating cabinet, the sheets were conditioned for 24 hours at 23° C. and 50% relative humidity. The water absorption capability was measured according to the standardized test method SCAN-P 12:64.

| Test | Grammes of water absorbed per $m^2$ sheet surface ($Cobb_{60}$) |
|---|---|
| Test without polymer | >160 |
| Test with polymer | 17.7 |

EXAMPLE 10

A dispersion prepared according to example 5 illustrates how the polymer improves the extensibility of fibre products.

To the dispersion was added a 2% fibre suspension of a neutral, unbleached birch sulphate pulp. The procedure when producing the sheet is identical to the one according to example 9. The extension of the sheets to breaking is determined in a semi-automatic paper tensile tester with digital read-out.

| Percentage of polymer on fibre weight | Percental improved extensibility of sheets relative to sheets without polymers |
|---|---|
| 0.5 | 10.5 |
| 5 | 26.3 |
| 10 | 43.0 |
| 20 | 81.6 |

EXAMPLE 11

Dispersions according to the invention give increased tensile strength in fibre products. A dispersion prepared according to example 2 shows how the tensile strength increases in sheets of recycled fibres.

A 20% fibre suspension was prepared through a suspension of daily newspapers in a mixture of equal parts of tap water and return water from a pulp factory. Aluminium sulphate was added to the fibre suspension to a level corresponding to 1% of the fibre weight. The preparation of sheets and tensile tests was carried out as in examples 9 and 10.

| Percentage of polymer on fibre weight | Percental improved tensile strength index in sheets relative to sheets without polymers |
|---|---|
| 0.5 | 8.6 |

-continued

| Percentage of polymer on fibre weight | Percental improved tensile strength index in sheets relative to sheets without polymers |
|---|---|
| 5 | 22.9 |
| 10 | 38.7 |
| 20 | 51.5 |

EXAMPLE 12

For e.g. pasteboard, there are often requirements for a high cross tensile strength, i.e. a high z-strength. A dispersion produced according to example 5 illustrate how the z-strength is increased in sheets prepared from a neutral fibre suspension consisting of defibrated printing shop waste. The preparation of the sheets takes place according to the earlier examples. The z-strength is measured according to the TAPPI Routine Control Method RC-308.

| Percentage of polymer on the fibre weight | Percental improved z-strength in sheets relative to sheets without polymer |
|---|---|
| 0.5 | 15 |
| 5 | 79 |
| 10 | 155 |
| 20 | 214 |

EXAMPLE 13

Dispersions according to the invention contain particles which show a positive surface charge in the environment prevailing when adsorptions of polymer takes place on negative charged fibre and filling particles. The addition of positive charged polymer particles involves a reduction of the negative surface charge, i.e. the z-potential, of fibres and filling in a water suspension. However, a lowering of the z-potential involves increased possibilities of colloidal-chemical unstability and to flocculating of suspended, colloidal material. At the manufacture of fibre products, the quantity of solid material deposited on the wire of the paper machine then increases, i.e. the fibre and filling retention increases.

Dispersions according to the invention function as retention agents according to the above-mentioned description. This is shown by the following example of a dispersion prepared according to example 3.

To a 2% neutral, bleached pine sulphate pulp was added ground chalk to a level which gives an ash content of 14.5% in fibre sheets produced according to the technique accounted for in the earlier patent examples. An addition of polymer dispersion to a suspension of the mixture of chalk and fibres involves an increase of the ash content, after this has been measured according to the test method SCAN-P 5:63.

| Percentage of polymers on total sheet weight | Ash content (%) |
|---|---|
| — | 14.5 |
| 0.5 | 16.8 |
| 1.0 | 19.0 |
| 2.0 | 20.2 |

EXAMPLE 14

In this example it is shown how polyethylene oxide in combination with the polymer dispersion according to the invention involves an increase of the retention of solid substance according to non-additive mechanisms. The example below was carried out identically to example 5, but with the difference that 0.05% water solution of polyethylene oxide was added to the fibre and chalk suspension 5 minutes after the polymer dispersion had been dosed. The polyethylene oxide chosen was Polyox® Coagulant (Union Carbide).

| Percentage of polymer[1] on total sheet weight | Percentage of polyethylene oxide on total sheet weight | Ash content % |
|---|---|---|
| — | — | 14.5 |
| — | 0.01 | 14.9 |
| 0.5 | — | 17.0 |
| 0.5 | 0.01 | 19.2 |

[1]Dispersion prepared according to example 2

EXAMPLE 15

Dispersions according to the invention function as a bonding agent in fibre sheets between cellulose fibres and solid substances which do not have the capability of developing their own bonds with cellulose fibres and with themselves. Examples of such substances are mineral fibres, shredded leather waste and shredded rubber waste. Composite products based upon these substances and cellulose fibres show, in the absence of bonding agent, insufficient strength and extensibility. The unbonded and loosely attached substances moreover tend to loosen, and dust is formed at the handling of composite products. These drawbacks can be avoided if the dispersion according to the invention is precipitated on cellulose fibres in a water suspension of cellulose fibres and e.g. mineral fibres, shredded leather waste or shredded rubber waste. The watering and drying gives coherent sheets with strength, extensibility and no tendency to produce dust.

The example below shows how the dispersion prepared according to example 6 can be used as a bonding agent in sheets consisting of cellulose fibres mixed with the fraction of shredded rubber waste which passes through a sieve with a mesh width of 30 Mesh. The rubber waste in the example was obtained from the leftovers formed in connection with retreading of tyres for motor cars.

Sheets were formed in a laboratory sheet forming device according to the technique accounted for in the foregoing claims. The 5% fibre suspension consisted of a mixture of 30% recycled fibres (daily newspapers) and 70% rubber. The suspension was transferred to pH 4.5 with sulphuric acid before the dosing of the dispersion. This was done in order to obtain recharging of the originally negative charged polymers to positive charged polymers which can be adsorbed on the negative loaded cellulose fibres.

| Percentage of polymer on total sheet weight | Percental improvement relative to sheets without polymers, as regards | |
|---|---|---|
| | tensile strength | extensibility |
| 1.5 | 22.8 | 8.9 |
| 3.0 | 50.4 | 19.4 |

-continued

| Percentage of polymer on total sheet weight | Percental improvement relative to sheets without polymers, as regards | |
|---|---|---|
| | tensile strength | extensibility |
| 6.0 | 77.8 | 29.1 |

In order to judge the tendency of the sheets to form dust, a tape is pressed with a pressure of 1 kp/cm$^2$ against the sheet. The tape is drawn off quickly, and judged with consideration to the quantity of rubber residue on the tape.

| Percentage of polymer on total sheet weight | Judging of tape with surface/cm$^2$ |
|---|---|
| — | Tape entirely covered by rubber fragments |
| 1.5 | 50–100 rubber fragments visible to the naked eye |
| 3.0 | 10–50 rubber fragments visible to the naked eye |
| 6.0 | <10 rubber fragments visible to the naked eye |

EXAMPLE 16

This example shows how the dispersion prepared according to example 1 can be used to bond leather waste in fibre sheets. The leather waste used in this case was the fraction of shredded cowhide which passes through a sieve with a mesh width of 20 Mesh. The sheets were produced on a laboratory sheet forming device in accordance with earlier examples.

| Components in sheet | Percental change compared with 100% recycled fibres | |
|---|---|---|
| | tensile strength % | extensibility % |
| 10% polymer<br>90% recycled fibres | +23.0 | +47.8 |
| 50% recycled fibres<br>50% leather waste | −62.4 | −26.7 |
| 10% polymer<br>45% recycled fibres<br>45% leather waste | −2.9 | −29.3 |

In addition to the considerably improved tensile strength and extensibility, the polymer contributed towards bonding the leather waste in the sheets so that these had considerably less tendency to give off dust.

EXAMPLE 17

Dispersions according to the invention consist of thermoplastic polymer in which the softening point of the polymer can be chosen through a choice of the proportion of hydrophobic softening monomer (e.g. 2-EHA) and hydrophobic hardening monomer (e.g. styrene). Dispersions with a softening point above the temperature at which the fibre products are to be used permits production of three-dimensional hot-formed fibre products with stable dimensions, from flat and dried out fibre sheets. The example given below shows that such hot forming is possible to carry out without previous moistening of the flat fibre sheet containing polymer. A prerequisite for this is that the polymer softens before the pressing stage, and that there is good affinity between polymer and fibres.

In order to illustrate the use of the invention, a metal form was prepared which permits a cup to be made from flat sheets of fibre containing dispersion produced according to example 7.

The dispersion was precipitated on recycled fibres (daily newspapers) in a 2% fibre suspension with neutral pH. The fibre suspension was dewatered in a laboratory sheet forming device. After couching, several wet sheets were built together to form a sheet construction which after pressing and drying had a thickness of 1.5 mm and a density of 1100 kg/cm$^3$. After conditioning for 24 hours at 23° C. and 50% relative humidity, the sheets were pre-heated to 140° C. and formed into a cup in a metal form which also had a temperature of 140° C. The plasticity is reflected in the degree of deep drawing which the cup can withstand before a rupture occurs in the most bent and extended sections of the sheet.

It is entirely impossible to form sheets without polymer into a cup according to the above-mentioned technique. Rupturing and delamination takes place immediately at the attempt to carry out the forming.

| Percentage of polymer in sheet | Deep drawing at rupture in cup (mm) |
|---|---|
| 10 | 8 |
| 15 | 15 |
| 20 | 20 |

The stability of the dimensions is determined as the springback in the cup after 24 hours of storage in room temperature. The spring back is calculated as the percental increase of the diameter of the cup from the original diameter immediately after the forming stage.

| Percentage of polymer in sheets | Spring-back (%) |
|---|---|
| 10 | 3.3 |
| 15 | Zero |
| 20 | Zero |

We claim:

1. An aqueous composition for preparing sheet-formed fibrous products comprising water suspended fibrous material and 0.5–20 percent by weight calculated as dry polymer based on dry fibre of a bonding agent comprising a particle-shaped polymer product dispersed in water and being produced through emulsion polymerization in the presence of an emulsifying system thereto adapted, having a particle size of 0.05–0.3 μm, having a cation-active charge at least in environments in which the pH is below 7, and comprising based on the entire quantity of monomer in the bonding agent (a) 95–65% by weight of a hydrophobic monomer selected from the group of styrene, 2-ethyhexyl acrylate, butyl acrylate and mixtures thereof;

(b) 3–30% by weight of a hydrophilic monomer selected from the group of acrylamide, methacrylamide, acrylonitrile, 2-hydroxyethyl methacrylate, vinyl pyrrolidone and mixtures thereof;

(c) 0.5–5.0% by weight of a cation-active charged monomer selected from the group of acrylic compounds, methacrylic compounds, and mixtures thereof having the formula:

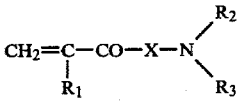

in which $R_1$=H or $CH_3$ $R_2$=$C_1$—to $C_4$ alkyl, —$CH_2$—OH or —$CH_2$—$CH_2$—OH $R_3$=—H or either of the alternatives according to $R_2$ and

X=—O—$CH_2$—$CH_2$—, —O—$CH_2$—$CH_2$—$CH_2$—,

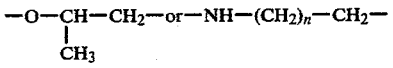

in which n=0 to 3.

2. The composition of claim 1 which further comprises (d) 0.2–2 percent by weight of a strongly basic acrylate monomer containing a quartenary ammonium group and having $PK_b$ value<3.

3. The composition of claim 1 or 2 characterized in that a cation-active surfactant of the formula

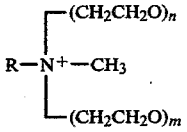

in which R=a hydrocarbon radical with 8–20 carbon atoms, while n and m=5–30 is utilized in the polymerization of the recited monomers.

4. The product of claim 1 or 2 which further comprises:

(e) 0.25–5 percent by weight based on the total quantity of monomer of a slightly acid monomer selected from the group of acrylic acid, methacrylic acid, itaconic acid and mixtures thereof.

5. The composition of claim 1 which includes 20–88 percent by weight styrene, 0–68 percent by weight 2-ethylhexyl acrylate, 5–20 percent by weight acrylamide and 1–4 percent by weight dimethyl aminoethyl methacrylate, the percents being based on the total quantity of monomer, and wherein the dispersion has a cation-active charge, at least pH<7.

6. The composition of claim 1 or 2 which further includes 5–50 percent by weight based on the polymer quantity of aluminum sulphate dispersed in the water.

7. The composition of claim 1 or 2 characterized in that an anion-active surfactant selected from the group of lauric acid, stearic acid and mixtures thereof is utilized in the emulsion polymerization of the recited monomers in a quantity corresponding to 0.25–4.0 percent by weight of the total quantity of monomer.

8. The composition of claim 7 which further employs a non-ionic surfactant in the emulsion polymerization of the recited monomers in an amount corresponding to 0.1–2.0 percent by weight based on the total quantity of monomer.

9. A method for producing a sheet-formed fibrous product which comprises admixing water suspended fibrous material and 0.5–20 percent by weight calculated as dry polymer based on dry fibre of a bonding agent comprising a particle-shaped polymer product dispersed in water and being produced through emulsion polymerization in the presence of an emulsifying system thereto adapted, having a particle size of 0.05–0.3 μm, having a cation-active charge at least in environments in which the pH is below 7, and comprising based on the entire quantity of monomer in the bonding agent (a) 95–65% by weight of a hydrophobic monomer selected from the group of styrene, 2-ethylhexyl acrylate, butyl acrylate and mixtures thereof;

(b) 3–30% by weight of a hydrophobic monomer selected from the group of acrylamide, methacrylamide, acrylonitrile, 2-hydroxyethyl methacrylate, vinyl pyrrolidone and mixtures thereof;

(c) 0.5–5.0% by weight of a cation-active charged monomer selected from the group of acrylic compounds, methacrylic compounds, and mixtures thereof having the formula

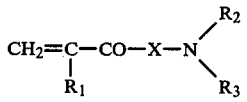

in which $R_1$=H or $CH_3$ $R_2$=$C_1$—to $C_4$ alkyl, —$CH_2$—OH or —$CH_2$—$CH_2$—OH $R_3$=—H or either of the alternatives according to $R_2$ and

X=—O—$CH_2$—$CH_2$—, —O—$CH_2$—$CH_2$—$CH_2$—,

—O—CH(CH$_3$)—$CH_2$—or—NH—$(CH_2)_n$—$CH_2$— in which n=0 to 3, and dewatering and drying the mixture.

10. The process of claim 9 wherein 0.001–0.1 percent by weight of high-molecular polyethylene oxide calculated as dry polymer based on dry fibre is added after the bonding agent and fibre suspension are admixed.

11. A composition according to claims 1 or 2 characterized in that a cation-actve surfactant is utilized at the emulsion polymerization of the monomers comprised, this surfactant then being comprised in a quantity corresponding to 0.25–5.0 percent by weight of the total quantity of monomer.

12. A composition according to claim 11 characterized in that it is produced according to a pre-emulsifying technique, 0.25–1.0 percent by weight counted on the total quantity of monomer of a non-ionic surfactant then being used to achieve an emulsion between monomer and water.

13. A composition according to claim 12, characterized in that the non-ionic surfactant is a nonyl phenol adduct with 20–30 ethylene oxide units stored up.

* * * * *